US011661323B2

(12) United States Patent
Rossato

(10) Patent No.: US 11,661,323 B2
(45) Date of Patent: May 30, 2023

(54) DEVICE FOR LIFTING LOADS

(71) Applicant: O.ME.R. S.p.A., Mirano (IT)

(72) Inventor: Orietta Rossato, Mirano (IT)

(73) Assignee: O.ME.R. S.P.A., Mirano (IT)

( * ) Notice: Subject to any disclaimer, the term of this patent is extended or adjusted under 35 U.S.C. 154(b) by 104 days.

(21) Appl. No.: 17/609,027

(22) PCT Filed: May 14, 2020

(86) PCT No.: PCT/IB2020/054578

§ 371 (c)(1),
(2) Date: Nov. 5, 2021

(87) PCT Pub. No.: WO2020/230079

PCT Pub. Date: Nov. 19, 2020

(65) Prior Publication Data

US 2022/0212907 A1 Jul. 7, 2022

(30) Foreign Application Priority Data

May 16, 2019 (IT) ..... 102019000006900

(51) Int. Cl.

| | |
|---|---|
| ***B66F 7/00*** | (2006.01) |
| ***B66F 7/28*** | (2006.01) |
| ***B66F 7/04*** | (2006.01) |
| *B66F 7/20* | (2006.01) |

(52) U.S. Cl.
CPC ..... *B66F 7/28* (2013.01); *B66F 7/04* (2013.01); *B66F 7/20* (2013.01); *B66F 2700/12* (2013.01)

(58) Field of Classification Search
CPC ..... B66F 7/00; B66F 7/04; B66F 7/28
See application file for complete search history.

(56) References Cited

U.S. PATENT DOCUMENTS

| | | | |
|---|---|---|---|
| 3,582,043 | A | 6/1971 | Tranchero |
| 5,984,616 | A | 11/1999 | Youmans |
| 9,637,364 | B2 | 5/2017 | Nussbaum |

(Continued)

FOREIGN PATENT DOCUMENTS

| | | | |
|---|---|---|---|
| CA | 2729021 | A1 | 1/2010 |
| DE | 202009007646 | U1 | 8/2009 |

(Continued)

*Primary Examiner* — Lee D Wilson
(74) *Attorney, Agent, or Firm* — Carmel Patent Agency; Robert J. Ballarini

(57) ABSTRACT

A device for lifting a load includes: a column with a carriage sliding along the column; a structure, which is associated with the carriage, for supporting the load to be lifted; and an actuator that moves the carriage causing the load supporting structure to rise and/or descend. The supporting structure of the load includes: a single supporting arm; a longitudinal arm, having first and second ends, which is associated with the supporting arm, at the other end of the supporting arm, so as to be rotatable with respect to the supporting arm, the longitudinal arm being telescopic at one or both ends; and arms provided at one or both ends of the longitudinal arm and which develop in a transverse, or angled, direction with respect to the longitudinal arm, the arms being provided and/or configured to be engaged by members to support and/or sustain the load to be lifted.

20 Claims, 4 Drawing Sheets

(56) References Cited

U.S. PATENT DOCUMENTS

| | | | | |
|---|---|---|---|---|
| 11,305,972 | B1 * | 4/2022 | Elliot | B66F 7/28 |
| 2015/0166313 | A1 | 6/2015 | Knapp | |
| 2015/0232308 | A1 | 8/2015 | Uhl | |
| 2015/0329336 | A1 * | 11/2015 | Brown | B66F 7/28<br>254/89 H |
| 2016/0122168 | A1 * | 5/2016 | Benz | B66F 7/28<br>254/133 R |
| 2016/0145085 | A1 | 5/2016 | Finkbeiner | |
| 2017/0183208 | A1 | 6/2017 | Hasler | |
| 2018/0072543 | A1 * | 3/2018 | Rucker | B66F 3/00 |
| 2019/0276287 | A1 * | 9/2019 | Huber | B66F 3/36 |
| 2021/0114852 | A1 * | 4/2021 | Heath | B66F 7/28 |
| 2022/0212907 | A1 * | 7/2022 | Rossato | B66F 7/04 |

FOREIGN PATENT DOCUMENTS

| | | | |
|---|---|---|---|
| GB | 2536272 | A | 9/2016 |
| JP | S5249544 | A | 4/1977 |
| JP | 2016044071 | A | 4/2016 |
| WO | 2017070564 | A2 | 4/2017 |

* cited by examiner

FIG. 1
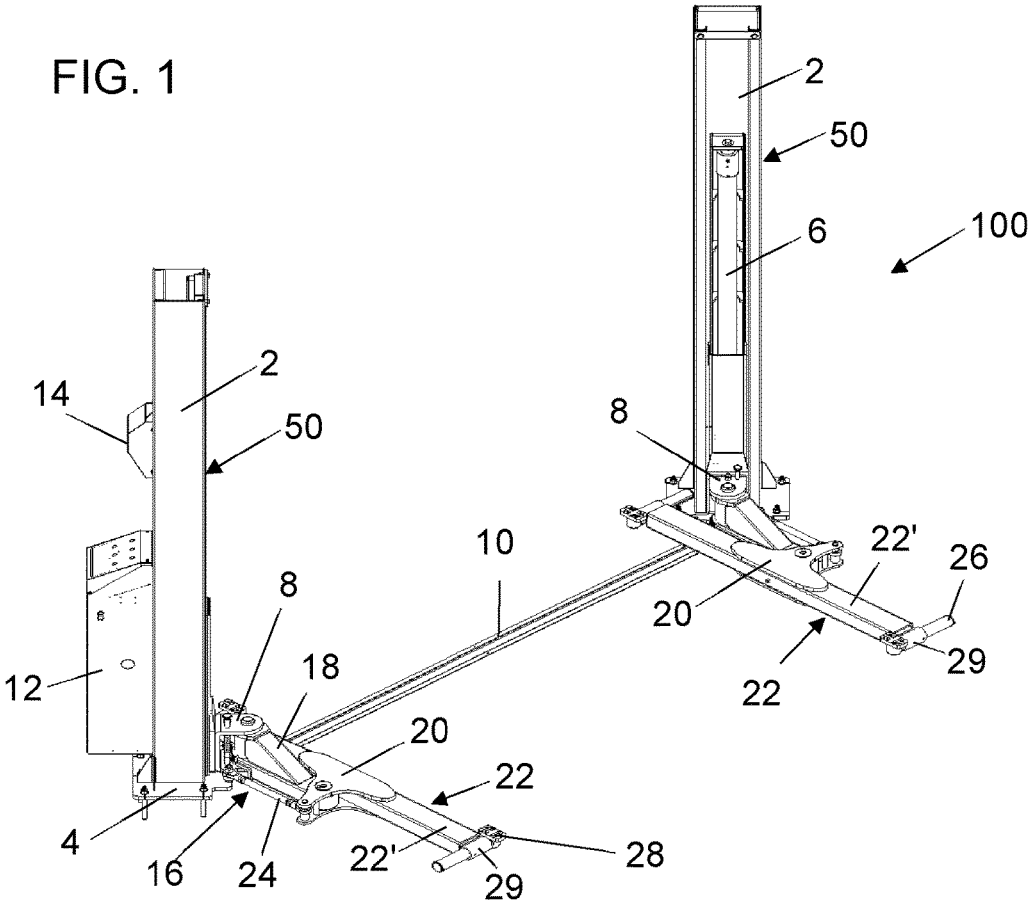
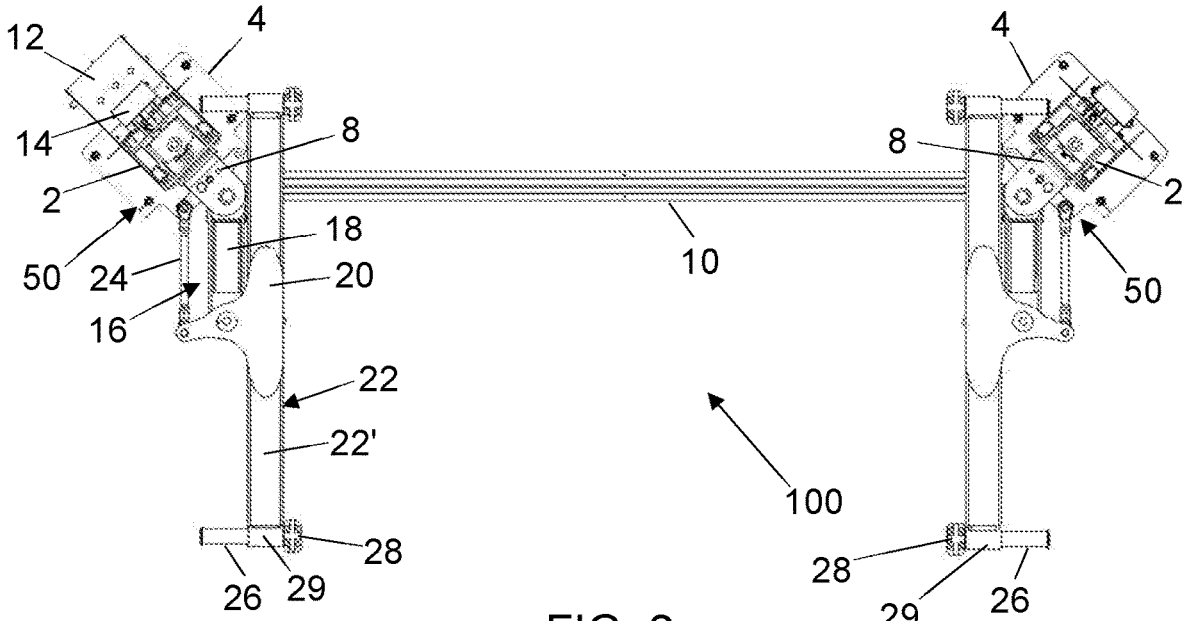
FIG. 2

DEVICE FOR LIFTING LOADS

INVENTIVE FIELD

The present invention relates to a device for lifting a load and more particularly for lifting a motor vehicle.

BACKGROUND

Apparatuses for lifting a load are known, and more particularly for lifting motor vehicles, which are generally used inside workshops in order to allow operators to access the lower areas of the motor vehicles for carrying out maintenance and/or repair.

Among the known vehicle lifting equipment there are those consisting of two or more column devices which are mobile inside the workshop, or of another room or yard, and which are mechanically independent, but are electronically connected and in communication between them, wired or wireless.

In particular, each column device comprises a vertical support column along which a structure comprising a carriage provided with substantially horizontal and variously shaped arms for the engagement of the corresponding areas of the vehicle to be lifted slides vertically. Suitably, the carriage with the arms that engage and come into contact with the load to be lifted defines, within the lifting device, the structure designed to support the load and keep it in a suspended condition following its lifting.

The column is also provided with actuation means, for example of an electromechanical or hydraulic type, for raising/lowering the carriage with the arms with respect to the vertical support, as well as a suitable control system and a display for interfacing with the operator.

In order to ensure the synchronism of the actuation means to cause the carriages to move along the respective columns, a connection is provided between the actuators themselves and this connection can be provided at the base of the two columns or at the upper end of the same.

In more detail, the arms of each column device are cantilevered to the carriage sliding along the column and are provided at the free end with support and/or grip members that can be positioned under a motor vehicle placed between two of these devices for its lifting.

Conveniently, each arm of the supporting structure of each column device can advantageously be of the telescopic type, so that the supporting and/or gripping member provided at the free end thereof can reach practically any position below the body of the motor vehicle, previously positioned on the ground between the two columns to be raised.

Examples of these known column devices for lifting motor vehicles are described for example in CA2729021, US2015/0232308, GB2536272, U.S. Pat. No. 9,637,364 and US2016/145085.

Examples of these known column devices for lifting motor vehicles are described for example in CA2729021, US2015/0232308 and GB2536272, U.S. Pat. No. 9,637,364, US2016/145085.

A drawback that often occurs in the use of these known lifting devices is linked to the need to position the supports, provided at the free end of the articulated arms, exactly at the points of the body of the motor vehicle intended for their support for lifting. This correct positioning is very often made difficult by the movements that the horizontal arms make to reach it, since each movement of the arm, both angular and telescopic, determines both a longitudinal and a transverse movement of the respective support.

Another drawback consists in the fact that when the vehicle is raised the two arms of each column device constitute two obstacles for the personnel who must work on the motor vehicle and who must move alongside it.

Another drawback consists in the fact that very often the columns also constitute an obstacle to the normal work that the personnel must carry out alongside the vehicle and can in particular prevent the complete opening of the doors, especially the front doors, to allow access to the front of the passenger compartment, as is often required in maintenance work on cars in general and electric cars in particular.

Another drawback consists in the fact that for balancing reasons the motor vehicle must be placed between the two lifting devices in a longitudinally centered position and this means that the presence of the columns and the arms articulated to them accentuate the previous drawback, given that the effect of obstruction to the free movement of personnel alongside the vehicle occurs precisely at the most critical position for carrying out these movements.

Another drawback consists in the fact that, when the motor vehicle must be positioned between the two column lifting devices, the two arms articulated to each column must be arranged parallel to the longitudinal axis of the motor vehicle so as not to hinder the positioning of the motor vehicle itself in the correct position for its lifting, and only after this positioning the arms must be swung to position their free end under the body. However, depending on the final position of the motor vehicle to be lifted, its dimensions and its conformation, its wheels and any parts of the body protruding from the bottom can be an obstacle to this swing and very often require to be kept in a minimum size configuration. until they have to be rotated and only afterwards can they be stretched until they are brought to the required size. However, this stretching maneuver can be uncomfortable and laborious due to the presence of the motor vehicle.

JP2016044071 describes a device for lifting a vehicle in which each column is provided with a carriage movable vertically along said column. Each carriage is provided with a pair of arms, both bearing, arranged so that one arm acts at the front of the vehicle while the other arm acts at the rear of the vehicle. In particular, means for receiving the tires of the vehicle are mounted at the ends of each arm of said pair of supporting arms.

JPS5249544 describes a lifting device with two columns, which are connected to each other by means of an articulated element consisting of a plurality of arms.

U.S. Pat. No. 3,582,043 describes a lifting apparatus comprising an "L"-shaped structure and consisting of a vertical frame, consisting of four fixed uprights, from whose base protrude two arms, telescopically adjustable in length and diverging from each other, and a second articulated frame with respect to the first and operable with upward movement through a cylinder with an hydraulic piston; the second frame is solidly constrained to a horizontal support base of the load to be lifted which is substantially double "T" shaped.

U.S. Pat. No. 5,984,616 describes a towing device to be mounted on the chassis of a vehicle; in particular, said device comprises a first frame mounted on the vehicle and a second frame which is rotatably fixed to said first frame to move between a retracted position, adjacent to the first frame and an extended position, spaced from the first frame. The telescopic beam extends from the second frame and ends in a carriage, which is adapted to support the wheels of a vehicle to be towed.

SUMMARY

The object of the invention is to propose a column device for lifting a load, in particular a motor vehicle, which eliminates, as a whole or in part, the drawbacks of traditional solutions.

Another object of the invention is to propose a device, which allows a precise, rapid, and easy positioning of the supports for the body of the motor vehicle to be raised at the points provided by the vehicle manufacturer.

Another object of the invention is to propose a device, which involves a limited obstacle for operators who have to work on the sides of the raised vehicle.

Another object of the invention is to propose a device, which allows an easy and complete opening of the doors, especially of the front doors of the motor vehicle, to allow personnel to access, as in particular electric motor vehicles, is required, in the front part of the interior.

Another object of the invention is to propose a device, which does not involve any obstacle to the correct positioning of the lifting arms by the wheels of the motor vehicle to be lifted.

Another object of the invention is to propose a device, which allows to keep the motor vehicle raised in an advanced position with respect to the columns, so that these are of limited obstacle to the complete opening of its front doors.

Another object of the invention is to propose a device, which is alternative and/or improving, compared to traditional solutions.

Another object of the invention is to propose a device which is simple and easy to use.

Another object of the invention is to propose a device which allows to lift motor vehicles of various lengths.

Another object of the invention is to propose a device which can be implemented easily, quickly and with low costs.

All these purposes, considered both individually and in any combination thereof, and others that will result from the following description are jointly or separately achieved with a device with the characteristics indicated in the independent claim.

BRIEF DESCRIPTION OF THE DRAWINGS

The present invention is further clarified below in some of its details. Preferred forms of practical embodiment, given purely by way of non-limiting example with reference to the attached drawings, in which:

FIG. 1 shows a perspective view of an apparatus comprising two lifting devices according to the invention in rest condition, with the respective arms on the ground and more widely spaced from each other, FIG. 2 shows it in plane.

DETAILED DESCRIPTION OF THE PREFERRED EMBODIMENTS

Figure 3:
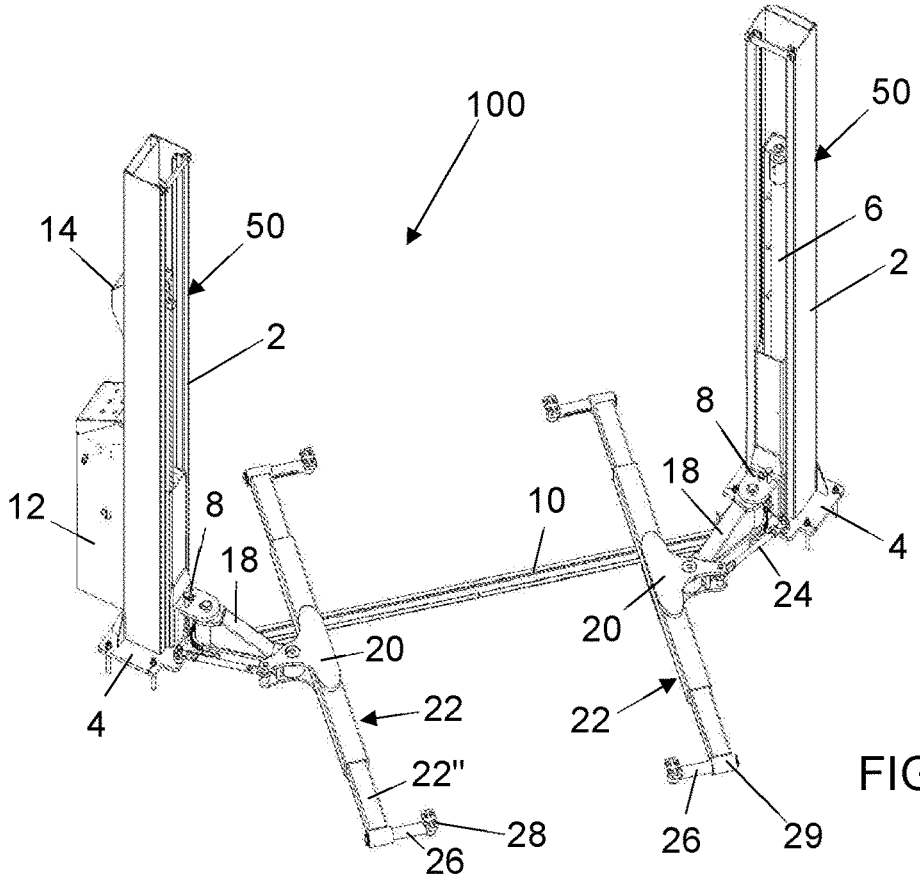
FIG. 3 shows it in perspective view with the arms on the ground but already arranged to lift a motor vehicle, that is close to each other and with a support for the body in operating position.
Figure 4:
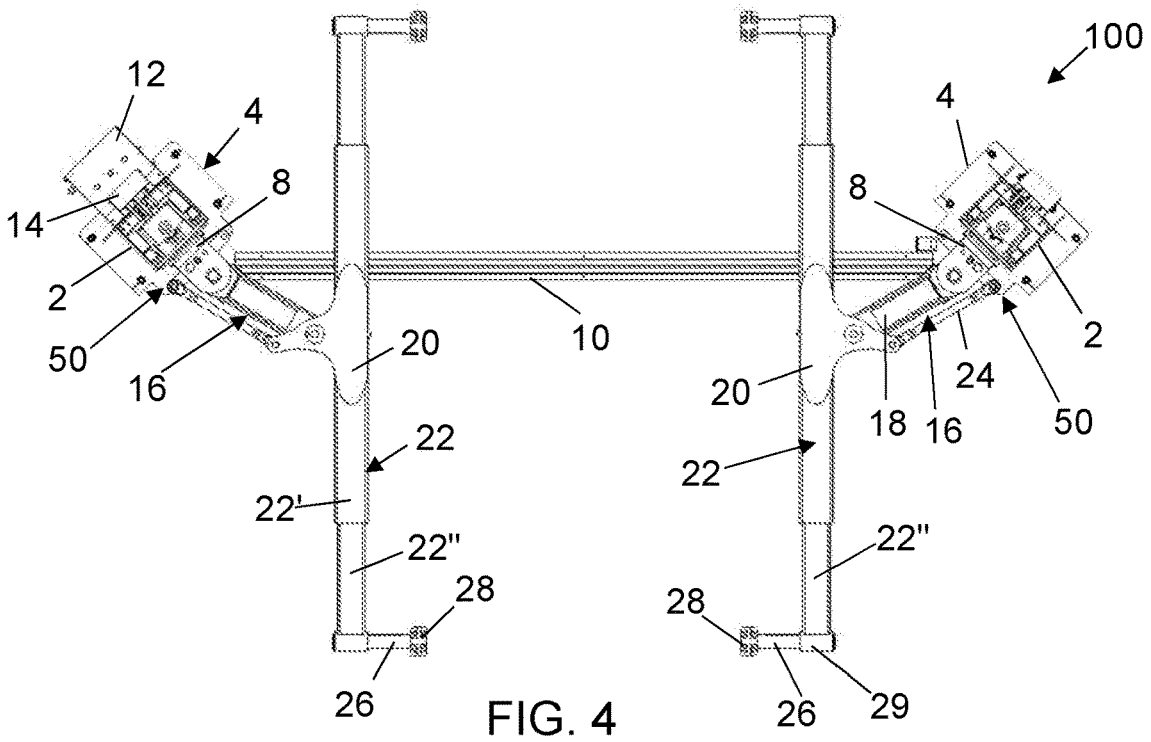
FIG. 4 shows it in plane.
Figure 5:
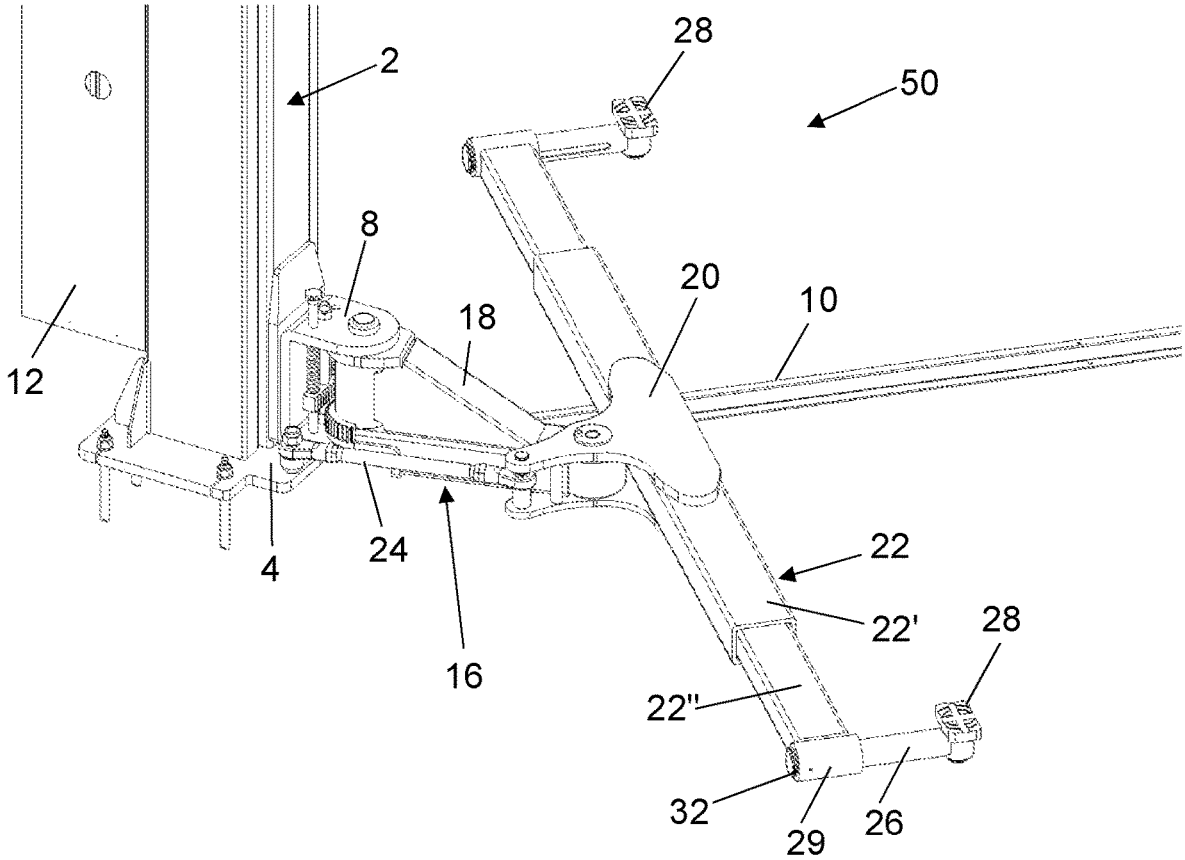
FIG. 5 is a perspective view of the enlarged detail of the lifting arm of a device according to the invention in the condition shown in FIG. 4.

As can be seen in FIGS. 1-4, the apparatus 100 comprises two devices 50, according to the invention, for lifting a load, preferably a motor vehicle.

Conveniently, the apparatus 100 described below comprises a pair of devices 50, however it is understood that it could also include two or more pairs of devices 50.

Each device 50 comprises a column structure 2, advantageously with a quadrangular section.

Conveniently, the column 2 can be provided at the bottom with a plate anchoring to a floor, for example a workshop or a yard. Conveniently, the column 2 can be provided at the bottom with means, for example a base with wheels, for its movement within the work room.

The device 50 also comprises a carriage 8 which is moved/slides along the column 2.

The carriage 8 is associated with a supporting structure 16 for loading. Conveniently, the supporting structure 16 comprises an arm 22 with a substantially longitudinal development and, at each (at least one) end of said longitudinal arm 22, an arm 26 is installed. In particular, the supporting structure 16 comprises a single longitudinal arm 22. Preferably, the longitudinal arm 22 is straight, but could have longitudinal development with one or more curved sections.

The supporting structure 16 also comprises arms 26, which are provided at both ends of said longitudinal arm 22 which develop in a direction substantially transverse, or in any case angled, with respect to the axis of said longitudinal arm 22. Conveniently, the arms 26 are provided and/or configured to be engaged by members 28 for supporting and/or sustaining the load to be lifted.

In particular, the longitudinal arm 22 is arranged substantially horizontally, while the column 2 develops vertically. Preferably, the longitudinal arm 22 lies on a substantially horizontal plane (or parallel to the supporting floor of the column 2), and is moved with respect to the column 2 and the carriage 8.

Each lifting device 50 is also provided with means for moving the carriage 8 along said column 2. In particular, said moving means of the carriage 8 comprise at least one actuator 6, of the electromechanical or hydraulic or pneumatic type, for moving the carriage 8, with the load supporting structure 16, along the column 2.

Preferably, the actuator 6 is housed inside the column 2. Advantageously, the actuator 6 can be constituted by a hydraulic jack, with a cylinder fixed to the same column and with a sliding piston inside the cylinder and having the stem protruding upwards and mechanically constrained to the carriage 8, thus causing the latter to slide along the column 2.

Advantageously, the apparatus 100 also comprises at least one control unit which, preferably, can be defined by a control unit 12, to control the actuator 6 for moving the carriage 8 and/or other actuator elements provided in the device 50. Suitably, each device 50 can be equipped with a control unit, or a single/single control unit can be provided for all the devices 50 of the apparatus 100. Suitably, the control unit can be installed on board the device 50, or of all the devices 50 of the apparatus 100, or it can be installed externally with respect to the devices 50 of the said apparatus.

Advantageously, it can also be provided that the actuator 6 of each lifting device 50 of the apparatus 100 can be controlled by its own/dedicated control unit, and that the control units of the devices are connected to each other with cable connections or wireless, preferably Wi-Fi, to ensure synchronism of operation. Preferably, the control of the lifting devices 50 of the apparatus 100 can be of the master-slave type, where one device is set to operate as a master, while the other (or the other) device (s) are set to operate as a slave.

Conveniently, the apparatus 100 comprises a user interface for controlling and commanding each device 50 of the apparatus itself. Suitably, a single/unique user interface can be provided for all the devices of the apparatus 100, which is mounted on board one or all of the devices or which can be external with respect to the devices (thus operating substantially as a remote control). Conveniently, each lifting device 50 can comprise its own dedicated user interface for the control and command of the device itself or of the other devices with which it is connected and in communication. In particular, the user interface can comprise a display apparatus, for example a screen 14, and a configuration panel provided with input means, which can be operatively activated by the operator. For example, the user interface may comprise a touch screen and/or a display monitor associated with a keyboard/push-button panel.

Advantageously, each lifting device 50 can also be provided with an electromechanical stop to permanently block the vertical movement of the load supporting structure 16 with respect to the column 2.

Advantageously, according to the requirements, the carriage 8 can be directly connected to a transmission pulley of a chain fixed with one end to the column 2 and with the other end to the carriage 8. Conveniently, in the first case the stroke of the carriage 8 along the respective column 2 is equal to the elongation of the piston, while in the second case the travel of the carriage 8 along the respective column 2 is double with respect to the elongation of the piston.

Advantageously, the actuators 6 of the facing columns 2 of the respective lifting devices 50 can be synchronized with each other so as to ensure that the carriages 8 move identically along the respective columns 2. Conveniently, this synchronization can be obtained in the traditional way by suitable control systems, and in particular with a Master-Slave hydraulic connection in series, with conduits running on the ground and protected by a conduit 10, flattened so as not to obstruct the transit of the motor vehicle to be lifted, or running at high altitude, supported by special air connection structures.

Advantageously, as mentioned, the two columns 2 of the devices 50 can be connected to each other by means of a conduit 10 positioned in correspondence of the floor and inside which electrical connection cables run between the two devices and/or hydraulic connection pipes between said two devices. Conveniently, the conduit 10 containing the electrical connection cables and/or the hydraulic connection pipes could be mounted at the upper ends/areas of the two columns 2.

Advantageously, in an embodiment not shown, the two columns 2 of the devices 50 can be connected to each other by means of an elastic compensation element—for example a spring—which can be associated at the lower ends/areas or—preferably—the upper ends/areas of the two columns 2. Advantageously, the elastic element of compensation contains and/or supports the electrical connection cables between the two devices and/or the hydraulic connection pipes between said two devices. Suitably, being flexible, in the event of an impact, the elastic element does not cause damage to the devices and/or to the load positioned between them.

Advantageously, in a possible embodiment, the control unit 12 is applied to one of the two columns 2, which, preferably, is electronically connected to a drive motor of a hydraulic pump associated with an oil tank, which feeds the actuator jacks 6. Advantageously, in a possible embodiment, a series of control buttons for operating the control unit 12 and indicators (for example defined by lights) for signaling the various conditions can be provided on the upper part of the control unit casing, which are suitably viewable in a possible screen 14, which can be applied to the column 2, in a position above the control unit 12.

Advantageously, in a possible/alternative embodiment, the actuator 6 of each column 2 can be powered and controlled by its own control unit, and that the two control units are connected to each other with wireless connections, preferably of the Wi-Fi type, to ensure synchronism of operation.

Conveniently, as mentioned, the carriage 8 has the supporting structure 16—particularly articulated—associated thereto. Advantageously, the supporting structure is associated with the carriage 8 so as to be able to rotate, relative to the latter, around an axis of articulation that is vertical or substantially vertical.

The supporting structure 16 comprises a single supporting arm 18 which is articulated to the longitudinal arm 22 and which is also articulated to the carriage 8. Conveniently, the supporting arm 18 connects the carriage 8 to the longitudinal arm 22, and in particular to a bracket 20 fixed to the latter.

Conveniently, only one supporting arm 18 is hinged to the carriage 8 of each device 50.

Conveniently, the supporting arm 18 is articulated to the longitudinal arm 22 by means of a bracket 20, which is fixed/integral with the latter while it is articulated to the supporting arm 18. Conveniently, the articulation axis of the supporting arm 18 to the carriage 8 and the articulation axis of the supporting arm 18 to the longitudinal arm 22 are parallel to each other and are oriented substantially vertically.

Suitably, the supporting arm 18 is configured as a robust arm that supports/sustains the longitudinal arm 22, the arms 26 mounted on the latter, and also the load to be lifted resting on said arms. In essence, the supporting arm 18 is configured—in terms of shape, dimensions and/or materials—so as to support/sustain substantially by itself the weight of the longitudinal arm 22 and of the arms 26, as well as the weight of the relative load to be lifted.

Conveniently, the supporting structure 16 also comprises a secondary arm 24, which has no substantial carrying, and supporting function of the longitudinal arm 22, of the arms 26 mounted on the latter, and/or of the load to be lifted. Suitably, also the secondary arm 24 is articulated to the longitudinal arm 22 and is also articulated to the carriage 8. Conveniently, the secondary arm 24 serves substantially to vary the inclination of the longitudinal arm 22 with respect to the supporting arm 18, and in particular therefore allows to varying the angle that the longitudinal arm 22 forms with the supporting arm 18.

Advantageously, the longitudinal development of the secondary arm 24 can be adjustable—manually or preferably by means of a corresponding actuator mounted and/or associated with the secondary arm 24—to thus modify the angle defined between the longitudinal arm 22 and the supporting arm 18; suitably, in this way, it is possible to vary the inclination of the longitudinal arm 22 on a corresponding horizontal plane in which the arm lies, to orient it/position it appropriately with respect to the load to be lifted, preferably with respect to the points of grip of said load or of the load vehicle to be lifted, for example in order to align it or orient it/position it substantially parallel to the side of the vehicle to be lifted. Advantageously, while the supporting arm 18 is formed from a single piece, it is preferable that the secondary arm 24 is telescopic. Advantageously, for example, said secondary arm 24 can be made in two parts which can be screwed together to vary the length of the arm itself and therefore to deform the parallelogram structure during the setting up of the device 50 and/or of the apparatus 100, and this in order to compensate for any installation irregularities of the former.

In particular, the secondary arm 24 is articulated to the carriage 8 in a point/axis of articulation different and distinct from that in which said supporting arm 18 articulates to said carriage 8. More in detail, said supporting arm 18 and said secondary arm 24 are articulated to the carriage 8 around two distinct articulation axes, parallel to each other but spaced apart.

In particular, the secondary arm 24 is associated in an articulated way with the longitudinal arm 22 by means of a corresponding articulation provided on the bracket 20, which is fixed/integral with said longitudinal arm 22 while it is articulated with the secondary arm 24. Conveniently, the supporting arm 18 and the secondary arm 24 are articulated to the bracket 20 which is integral with the longitudinal arm 22, or directly to the latter, around two distinct articulation axes which are parallel and spaced apart from each other.

Preferably, the supporting structure 16 can comprise an articulated parallelogram configuration. Advantageously, the secondary arm 24 defines a parallelogram structure with the main supporting arm 18, with the carriage 8 and with the bracket 20, thanks to a suitable choice of the points of articulation between the various elements. Conveniently, the articulation axes of said components are parallel to each other and oriented substantially vertically.

Advantageously, the longitudinal arm 22 comprises a first element 22', in particular tubular with a preferably rectangular section, which is constrained with its central portion, in particular by means of the respective bracket 20 and the supporting arm 18—and preferably also with the secondary arm 24—to the corresponding carriage 8. Advantageously, the longitudinal arm 22 can comprise a pair of second elements 22", also tubular and configured so as to come out from both ends of the first element 22' and sliding along the latter in order to make the overall length of the arm itself telescopically variable and therefore make it adaptable to vehicles of different characteristics.

Suitably, the telescopic lengthening/shortening of the longitudinal arm 22 can be motorized; advantageously, for this purpose, the second elements 22" are associated with suitable handling members, which preferably can be housed inside the first element 22'.

In a possible alternative embodiment, not shown in the figures, it is envisaged that the first element 22' is associated with a single second element 22" removable axially from one end of said element 22', which to the other end bears an arm 26.

Suitably, as said, at each (or at least one) end of the longitudinal arm 22, preferably telescopic, of the supporting structure 16, an arm 26 is associated. Preferably, the free end of the longitudinal arm 22—and in particular of the first element 22' and/or at least a second element 22"—an arm 26 is applied. Advantageously, the longitudinal development axis of the arm 26 is substantially orthogonal, or in any case angled, with respect to the axis of the longitudinal arm 22.

Conveniently, each arm 26 is axially movable within a corresponding insertion seat 29 provided in the longitudinal arm 22.

Conveniently, each insert seat 29 is defined by a tubular section welded to the end of the longitudinal arm 22. Conveniently, the insertion seat or seats 29 for the arms 26 develop orthogonally/transversely with respect to the longitudinal development of said longitudinal arm and, preferably, the longitudinal axes which pass through said insertion seat(s) 29 substantially lie on the same horizontal plane (i.e. substantially parallel with respect to the floor on which the column 2 of the device 50 rests). Advantageously, in a possible embodiment variant not shown, the insertion seat or seats 29 for the arms 26 are associated with the longitudinal arm 22 so as to be inclined with respect to the horizontal, and in particular with respect to a horizontal plane on which the arm lies longitudinal, to compensate for any play and deformation.

Advantageously, the coupling between each arm 26 and the respective insertion seat 29 is such as to ensure axial mobility of the arm 26 within its insertion seat 29, but to prevent its axial rotation. Suitably, this is preferably achieved by making the arm 26 with a non-circular section and complementary to the section of the seat which houses it.

Conveniently, in each arm 26 one can distinguish the inner end, furthest from the column 2, and the outer end, closest to it. Conveniently, each arm 26 is associated with a traditional member 28 for supporting and/or sustaining the load to be lifted; preferably, said member 28 is configured and intended to receive the provided body part of the motor vehicle to be raised in support. Preferably, the member 28 is mounted at the end of each arm 26 furthest from the column 2.

Advantageously, each arm can be from the constructive and functional point of view substantially of the type described and shown in the Italian patent application no. 102020000006085, the content of which is intended to be incorporated herein by reference.

Conveniently, the member 28 can be permanently fixed on the arm 26 or, given the considerable diversity between the various motor vehicles, it is advantageous that the support member 28 is removably mounted on the respective arm 26, in order to be replaced with another support member 28 of characteristics more suitable for the vehicle to be lifted; this can be achieved in a very simple way by making each arm 26 with the internal end presenting a hole 30 with a vertical axis and the support member 28 with a lower appendage which can be inserted removably within said hole.

Figure 6:
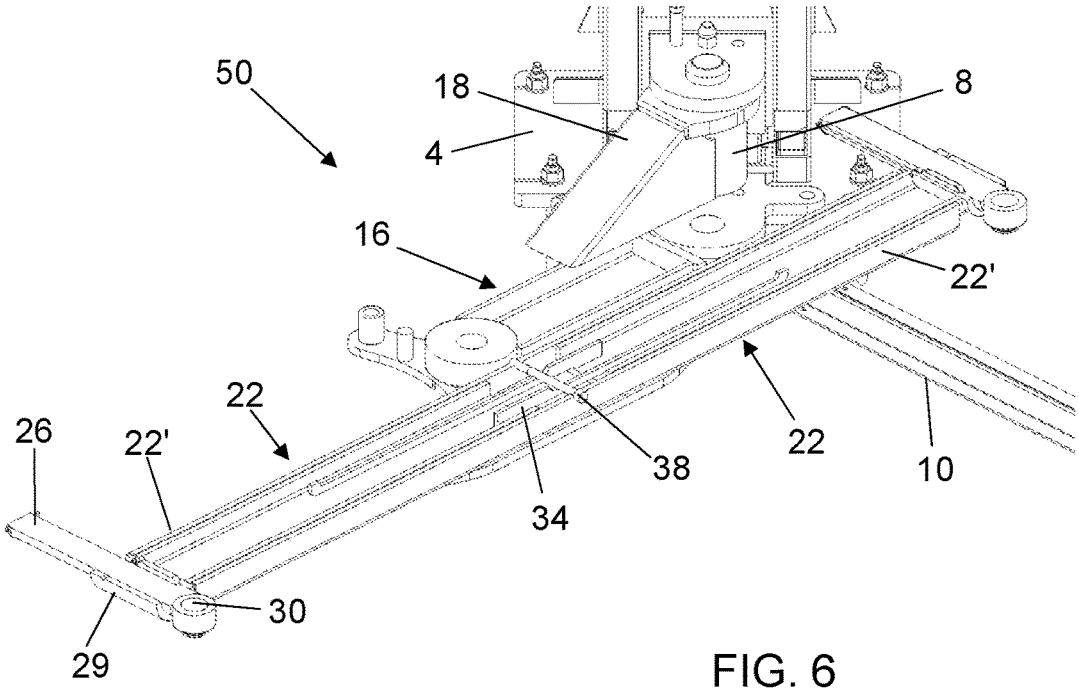
FIG. 6 shows it in a different perspective view, partially sectioned according to a horizontal plane, which highlights some of its internal parts.

Advantageously, the axial stroke of each arm 26 in its seat at the end of the longitudinal arm 22 is limited towards the outside by the presence of an enlargement, in which the through hole 30 is obtained (see FIG. 6), and towards the inside by an enlarged head 32.

Figure 7:
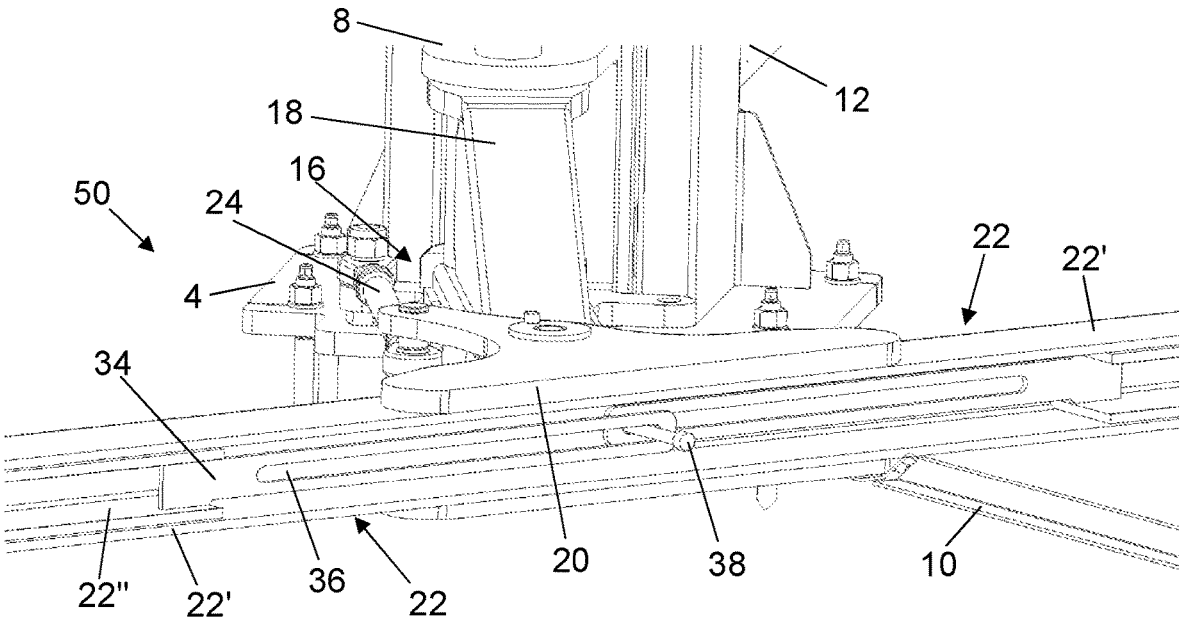
FIG. 7 shows it in an even different perspective view, partially sectioned according to a vertical plane, which highlights the internal parts.

Advantageously, the telescopic movements of the two second elements 22" of the longitudinal arm 22 towards the outside also have a limit stop to avoid their complete withdrawal. Preferably, this stop is obtained with an elongated plate 34, applied to the internal end of the corresponding second element 22" and running inside the first element 22'. It is presenting a longitudinal slot 36, in which a transverse pin 38 is fixed, fixed to the central part of the element 22' of the arm 22 (see FIGS. 6 and 7).

Suitably, the installation of each device 50 according to the invention can take place as described below. Preliminarily, it is advantageously provided that the respective column 2 is anchored with its plate 4 to the floor at the predetermined distance from the other device and it is preferable that the vertical surfaces of the two columns, from which the two carriages 8 protrude, are not parallel facing each other, but are oriented towards the front of the motor vehicle to be lifted, since generally the center of gravity of this is located towards its front.

After the columns 2 of the two lifting devices 50 have been firmly anchored to the floor at the distance provided for the range of widths of the motor vehicles to be lifted, it is necessary to make the fine adjustment of the longitudinal orientation of the two longitudinal arms 22 of the respective devices 50. Suitably, already at the design stage, the arrangement of the various parts is defined so that the longitudinal arms 22 are perfectly parallel to each other and to the longitudinal direction of the passage delimited between the two columns for positioning the motor vehicle to be lifted, but for the purpose to correct possible installation inaccuracies, it is possible to adjust the length of the secondary arms 24 of the two structures 16 with high precision, so as to ensure the perfect orientation of the two longitudinal arms 22.

Once these adjustments have been made, the apparatus 100, comprising the two devices 50 according to the invention, it is advantageously ready to work.

Conveniently, in the rest condition (FIGS. 1 and 2) the two carriages 8 are on the ground, the two longitudinal arms 22 are close to the respective columns 2 and are in a condition of minimum elongation, and the arms 26 present at their ends are arranged at the end of the external stroke. To lift a motor vehicle, it must be positioned between the two columns 2 in a position suitable for the correct positioning of the two longitudinal arms 22.

After the vehicle has been correctly positioned, the operator brings the two longitudinal arms 22 closer to the sides of the motor vehicle and to extend them telescopically until the distance between the arms 26 of each longitudinal arm 22 corresponds to the distance between the points of the body, to which the supports 28 must then rest.

Suitably, this telescopic extension can be carried out manually, or it can be motorized, if the longitudinal arms 22 are equipped with suitable moving members, and can advantageously be controlled by suitable commands provided in the control unit 12 or also by radio commands, if the control unit it is configured to receive and run them.

Subsequently, the operator brings the longitudinal arms 22 closer to the motor vehicle until the supports supported by the arms 26 are positioned at the points of the body of the motor vehicle provided for lifting it. Then it axially pushes the arms themselves towards the motor vehicle, so that their supports 28 are positioned exactly below those points.

Suitably, also in this case the maneuver can be performed manually or it can be motorized and in this case it can be controlled with the command interface associated with the control unit, for example by means of the buttons associated with the control unit 12 or by radio control.

Once this positioning maneuver is complete, the vehicle is ready to be lifted. In particular, by acting on the command interface, corresponding signals are sent to the control unit which thus activates the actuator 6 which causes the carriage 8 to rise until the supports 28 rest on the body of the motor vehicle and then, continuing the upward stroke, raise it to the desired height. Conveniently, for example in a possible embodiment, by giving a suitable command, the control unit 12 activates the pump which introduces oil into the jacks of the actuators 6, which extend, causing the carriages 8 to rise along the respective columns 2 until the supports 28 rest on the body of the motor vehicle and then, continuing the stroke, raise it to the desired height.

Thanks to the synchronization between the actuators 6 of the two devices 50 of the apparatus 100, their identical extension is ensured in order to maintain the balanced lifting of the motor vehicle.

Advantageously, it should be noted that the motor vehicle rests exclusively on the support members 28 and therefore weighs with its weight on the arms 26 and on the longitudinal arms 22 of the devices 50, and thus ensures by friction the locking of the second elements 22" to the respective first elements 22' and arms 26 to the respective second elements 22".

Advantageously, at the articulation of each supporting arm 18 of the supporting structure 16 to the respective carriage 8 one or more load cells can be provided, through which it is possible to control the weight of the raised vehicle.

Advantageously, the apparatus 100 comprises an optical mechanism for checking the alignment between the respective columns 2 and/or between the carriages 8 of the lifting devices 50, in particular during the lifting movement of the load. Preferably, this optical mechanism comprises a light emitter mounted on a column 2 and a photodetector (for example a photocell) mounted on the other column 2, or on the same column in which the emitter is mounted, and in this case on the other column a reflective element is mounted.

Advantageously, the optical mechanism is configured to activate automatically by going down by gravity when the carriages 8 of said lifting devices 50 reach a predefined height. In particular, suitably, the emitter/photodetector pair are mounted on a bracket which is vertically movable/sliding along the respective column 2 and which is configured to descend by gravity when the load supported by the supporting structure 16 is raised by the movement vertical upward movement of the carriage 8.

From what has been said it is clear that the lifting device according to the invention is much more advantageous than traditional lifting devices since:

- thanks to the obtained independence between the telescopic extension of the longitudinal arm 22 and the axial movement of each arm 26, it is possible to position each support 28 with extreme precision exactly below the point of the body, to which the vehicle must then rest in a raised condition, without making the lifting arms perform any swing that could interfere with the wheels or with parts of the body protruding below;
- the connection between the motor vehicle, when raised, and the column 2 is constituted by the supporting arm 18 by the load supporting structure 16, which in practice constitutes the only element which, coming out of the lateral bulk of the vehicle, can potentially hinder the movements of the operators on the side of the raised vehicle;
- thanks to the inclined arrangement of the single element, i.e. the supporting arm 18—for connecting the column 2 to the motor vehicle when it is raised, the position of said column with respect to the motor vehicle is rather backward and this means that the column itself is not of obstacle to the complete opening of the corresponding front door of the raised vehicle and to the access of the operators to the front of the passenger compartment;
- the telescopic extension maneuvers of the longitudinal arm 22 are carried out when the latter is outside the dimensions of the motor vehicle and therefore in conditions of maximum usability and precision.

The invention claimed is:

1. A device (50) for lifting a load, comprising:

a column (2) with a carriage (8) sliding along said column (2), a structure (16), which is associated with said carriage (8), for supporting the load to be lifted, an actuator (6) that moves said carriage (8) along said column (2), thus causing the load supporting structure (16) to rise and/or descend, wherein said supporting structure (16) of the load includes:

a single supporting arm (18) which, at a first end thereof, is articulated to said carriage (8), a longitudinal arm (22), having first and second ends, which is associated with said supporting arm (18), at the other end of said supporting arm (18), so as to be able to rotate with respect to said supporting arm (18), said longitudinal arm (22) being telescopic at one or both of the ends, arms (26) which are provided at one or both ends of said longitudinal arm (22) and which develop in a substantially transverse, or in any case angled, direction with respect to said longitudinal arm (22), said arms (26) being provided and/or configured to be engaged by members (28) to support and/or sustain the load to be lifted.

2. The device according to claim 1, wherein said arms (26) are mounted at both ends of said longitudinal arm (22) so as to be movable in a substantially transverse, or otherwise angled, direction relative to said longitudinal arm (22).

3. The device according to claim 1, wherein said single supporting arm (18) is configured in such a way that the movements of said longitudinal arm (22) are translational and maintain the longitudinal axis of said longitudinal arm axis of development (22) substantially parallel to the longitudinal axis of the load to be lifted.

4. The device according to claim 1, wherein said supporting structure (16) further comprises a secondary arm (24) which has no substantial bearing function of the longitudinal arm support (22), of the arms (26) mounted thereon, and/or of the load to be lifted, said secondary arm (24) being articulated to the longitudinal arm (22) and also being articulated to the carriage (8).

5. The device according to claim 4, wherein said secondary arm (24) is adjustable in length.

6. The device according to claim 4, wherein said supporting arm (18) is substantially made in a single piece, while said secondary arm (24) comprises at least two removable parts so as to enable a varying the length of said secondary arm (24).

7. The device according to claim 4, wherein said supporting arm (18) and said secondary arm (24) are articulated to the carriage (8) around two distinct and mutually parallel axes of articulation.

8. The device according to claim 4, wherein said supporting arm (18) and said secondary arm (24) are articulated to a bracket (20) fixedly connected to the longitudinal axis arm (22) around two distinct and parallel axes of articulation.

9. The device according to claim 1, wherein the longitudinal arm (22) is associated with said supporting arm (18) so as to be rotatable with respect to said supporting arm (18) through a bracket (20) that is integral with said longitudinal arm (22) and to which said end of the supporting arm (18) is hinged or articulated.

10. The device according to claim 1, wherein the supporting structure (16) comprises an articulated parallelogram configuration of which one side is defined by said supporting arm (18).

11. The device according to claim 10, wherein said articulated parallelogram configuration of said supporting structure (16) comprises:

a first side defined by said single supporting arm (18), a second side, articulated at one end of the first side and defined by a portion of said carriage (8), a third side, articulated at the other end of the first side, and defined by a portion of said longitudinal arm (22), and a fourth side consisting of a secondary arm (24) configured so as not to have any substantial load-bearing function and configured to define, with the other three sides, said articulated parallelogram structure (16).

12. The device according to claim 10, wherein the load to be lifted is a motor vehicle and said articulated parallelogram of said supporting structure (16) is configured such that, in an operative condition, the end of said single supporting arm (18) articulated to said longitudinal arm (22) is closer to a front part of the motor vehicle than to a rear part of the motor vehicle articulated to said carriage (8).

13. The device according to claim 1, wherein in correspondence of its ends, said longitudinal arm (22) is provided with respective insertion seats (29) within which are inserted corresponding arms (26) and wherein the engagement of each arm (26) within the respective insertion seat (29) it is such as to ensure axial mobility of the arm (26) within its insertion seat (29), but to prevent its axial rotation.

14. The device according to claim 1, further comprising members (28) for supporting and/or sustaining the load to be lifted said members (28) being fixed on said arms (26).

15. The device according to claim 1, wherein said arms (26) comprise a hole (30) within which is removably insertable at least one member (28) for sustaining and/or supporting the load to be lifted.

16. The device according to claim 15, wherein:

at least one second extractable element (22") is provided at one end of said telescopic arm (22) and comprises, at an external end thereof, means of constraint of said arm (26), said arm (26) is provided or intended to be engaged, at a furthest end thereof, with respect to said column (2), by said support member (28) for the body of a motor vehicle to be lifted, said arm (26) being axially movable to position the at least one member (28) below said body and is prevented from performing axial rotations.

17. The device according to claim 16, further comprising a limit stop, which prevents complete removal of at least a second element (22") from a first element (22'), within which said second element (22") is housed, said limit stop being provided at an internal end of said second element (22") and being housed inside said first tubular element (22').

18. The device according to claim 17, wherein said limit stop comprises:

a longitudinal slot (36) which is provided at the internal end of said at least a second removable element (22") of said telescopic arm (22) and which runs inside said first tubular element (22'), and a transverse pin (38) which is fixed to said first tubular element (22') and which is slidably engaged in said longitudinal slot (36).

19. The device according to claim 17, wherein said limit stop comprises:

a transverse pin (38) which is provided at the internal end of said at least a second removable element (22") of said telescopic arm (22) and which is housed inside said first tubular element (22')

a longitudinal slot (36) which is fixed to said first tubular element (22') and inside which said transverse pin (38) is slidably engaged.

20. An apparatus (100) for lifting a load, in particular for lifting a motor vehicle, preferably an electric motor vehicle, said apparatus (100) comprising at least a pair of lifting devices (50) according to claim 1.

* * * * *